US012089678B2

(12) United States Patent
Staky

(10) Patent No.: US 12,089,678 B2
(45) Date of Patent: Sep. 17, 2024

(54) SYSTEMS AND METHODS FOR MAGNETIC ATTACHMENT OF A HAIR PIECE

(71) Applicant: Kristy Michelle Staky, Los Angeles, CA (US)

(72) Inventor: Kristy Michelle Staky, Los Angeles, CA (US)

( * ) Notice: Subject to any disclaimer, the term of this patent is extended or adjusted under 35 U.S.C. 154(b) by 0 days.

(21) Appl. No.: 18/223,120

(22) Filed: Jul. 18, 2023

(65) Prior Publication Data

US 2023/0354938 A1 Nov. 9, 2023

Related U.S. Application Data

(63) Continuation of application No. 17/072,432, filed on Oct. 16, 2020, now Pat. No. 11,744,306.

(60) Provisional application No. 62/923,397, filed on Oct. 18, 2019.

(51) Int. Cl.
*A41G 5/00* (2006.01)

(52) U.S. Cl.
CPC ..... *A41G 5/0073* (2013.01)

(58) Field of Classification Search
CPC ..... A41G 5/00; A41G 5/0006; A41G 5/0013; A41G 5/0026; A41G 5/004; A41G 5/0046; A41G 5/0053; A41G 5/0073; A41G 3/00; A41G 3/0008; A41G 3/0033; A41G 3/0041; A41G 3/005; A41G 3/0058
See application file for complete search history.

(56) References Cited

U.S. PATENT DOCUMENTS

| | | | | |
|---|---|---|---|---|
| 11,606,996 | B1 * | 3/2023 | Clark | H01F 7/0263 |
| 2012/0103014 | A1 * | 5/2012 | Monroe | A45D 8/14 63/12 |
| 2016/0050996 | A1 * | 2/2016 | Kwon | A41G 3/0033 132/54 |
| 2019/0090567 | A1 | 3/2019 | Johnson | |
| 2019/0166938 | A1 * | 6/2019 | Bendavid | A41G 5/0073 |
| 2019/0216152 | A1 * | 7/2019 | Francis | A41G 5/0073 |
| 2019/0254372 | A1 * | 8/2019 | Rigby | A41G 5/0053 |
| 2019/0373973 | A1 * | 12/2019 | Richwine | A41G 5/0053 |
| 2020/0305529 | A1 | 10/2020 | Menotti | |
| 2023/0320445 | A1 * | 10/2023 | Christoffersen | A41G 5/0073 132/201 |

FOREIGN PATENT DOCUMENTS

WO 2016075679 A1 5/2016

* cited by examiner

*Primary Examiner* — Cris L. Rodriguez
*Assistant Examiner* — Karim Asqiriba
(74) *Attorney, Agent, or Firm* — Concept IP LLP; Pejman Yedidsion

(57) ABSTRACT

Systems, devices, and methods including: a clasp, the clasp comprising: a body; one or more magnets of the clasp attached to an outside portion of the body; and a middle portion configured to extend away from the body such that hair is configured to go between the middle portion and the body to secure the clasp to the hair; a stay, the stay comprising: one or more magnets of the stay; where the clasp is detachably attached to the stay via the one or more magnets of the clasp and the one or more magnets of the stay; and where the stay is configured to attach to a hair piece.

1 Claim, 8 Drawing Sheets

SYSTEMS AND METHODS FOR MAGNETIC ATTACHMENT OF A HAIR PIECE

CROSS-REFERENCE TO RELATED APPLICATIONS

This application is a continuation of U.S. Non-Provisional patent application Ser. No. 17/072,432, filed Oct. 16, 2020, which claims priority to and the benefit of U.S. Provisional Patent Application No. 62/923,397, filed Oct. 18, 2019, the contents of all of which are hereby incorporated by reference herein for all purposes.

TECHNICAL FIELD

Embodiments relate generally to hair pieces, and more particularly to attachment of a hair piece.

BACKGROUND

A hair piece or wig may be worn by a person with or without hair. For a person without hair, the hair piece may be secured to the head of the person via adhesives. These adhesives may cause discomfort to the person. For a person with hair, the hair piece may be secured to the head of the person via pins or clips. These pins or clips may similarly cause discomfort to the person. The application and removal of adhesives, pins, or clips may be time consuming to the person utilizing the hair piece.

SUMMARY

A system embodiment may include: a clasp, the clasp comprising: a body; one or more magnets of the clasp attached to an outside portion of the body; and a middle portion configured to extend away from the body such that hair may be configured to go between the middle portion and the body to secure the clasp to the hair; a stay, the stay comprising: one or more magnets of the stay; where the clasp may be detachably attached to the stay via the one or more magnets of the clasp and the one or more magnets of the stay; and where the stay may be configured to attach to a hair piece. In additional system embodiments, the clasp may be formed from a single piece of thin material, and where the stay may be formed from a thermosetting polymer that may not melt when heated. In additional system embodiments, the stay comprises a fabric casing surrounding at least a portion of the stay. In additional system embodiments, the clasp comprises a curved shape to allow the clasp to bow inwards and bow outwards. In additional system embodiments, applying a force to the clasp to bend the clasp outwards causes the middle portion to snap into place securing the clasp to any hair disposed between the body of the clasp and the middle portion of the clasp.

In additional system embodiments, the one or more magnets of the clasp comprise two magnets, where a first magnet of the two magnets of the clasp may be disposed at a top end of the clasp, where a second magnet of the two magnets of the clasp may be disposed at a bottom end of the clasp, where the one or more magnets of the stay comprise two magnets, where a first magnet of the two magnets of the stay may be disposed at a top end of the stay, and where a second magnet of the two magnets of the stay may be disposed at a bottom end of the stay.

In additional system embodiments, the stay further comprises a metal ridge running longitudinally between the first magnet of the stay and the second magnet of the stay. In additional system embodiments, the one or more magnets of the clasp comprise at least one of: Neodymium iron boron (NdFeb) magnets, Samarium Cobalt (SmCo) magnets, and Alnico magnets, and where the one or more magnets of the stay comprise at least one of: NdFeb magnets, SmCo magnets, and Alnico magnets.

Another system embodiment may include: a first stay comprising one or more magnets; a second stay comprising one or more magnets; where the first stay may be detachably attached to the second stay via the one or more magnets of the first stay and the one or more magnets of the stay; and where the first stay may be configured to attach to a hair piece.

In additional system embodiments, the second stay may be configured to attach to a wig cap to be worn on a head. In additional system embodiments, the one or more magnets of the first stay comprise two magnets, where a first magnet of the two magnets of the first stay may be disposed at a top end of the first stay, where a second magnet of the two magnets of the first stay may be disposed at a bottom end of the first stay, where the one or more magnets of the second stay comprise two magnets, where a first magnet of the two magnets of the second stay may be disposed at a top end of the stay, and where a second magnet of the two magnets of the second stay may be disposed at a bottom end of the second stay. In additional system embodiments, the first stay further comprises a metal ridge running longitudinally between the first magnet of the first stay and the second magnet of the first stay, and where the second stay further comprises a metal ridge running longitudinally between the first magnet of the second stay and the second magnet of the second stay.

Another system embodiment may include: a clip, the clip comprising: a body; a plurality of teeth extending from the body, where the teeth may be configured to slide through a hair and secure the clip to hair; one or more magnets of the clip attached to an outside portion of the body; and a stay, the stay comprising: one or more magnets of the stay; where the clip may be detachably attached to the stay via the one or more magnets of the clip and the one or more magnets of the stay; and where the stay may be configured to attach to a hair piece.

In additional system embodiments, the clip further comprises a bar running horizontally along a length of the clip, where the bar may be proximate an end of the plurality of teeth, and where the hair may be secured between the plurality of teeth and the bar. In additional system embodiments, the one or more magnets of the clip comprise a first magnet attached to a top portion of the outside portion of the clip.

In additional system embodiments, the first magnet runs laterally across the top portion of the clip, and where the first magnet may be distal from the bar. In additional system embodiments, the stay may be made from lace, and where the one or more magnets of the stay may be sewn directly into the stay with stitching. In additional system embodiments, the plurality of teeth may be curved.

In additional system embodiments, the one or more magnets of the clip comprise at least one of: Neodymium iron boron (NdFeb) magnets, Samarium Cobalt (SmCo) magnets, and Alnico magnets, and where the one or more magnets of the stay comprise at least one of: NdFeb magnets, SmCo magnets, and Alnico magnets. In additional system embodiments, the one or more magnets of the clip may be secured by at least one of: soldering and epoxy, and where the one or more magnets of the stay may be secured by at least one of: soldering and epoxy.

BRIEF DESCRIPTION OF THE DRAWINGS

The components in the figures are not necessarily to scale, emphasis instead being placed upon illustrating the principals of the invention. Like reference numerals designate corresponding parts throughout the different views. Embodiments are illustrated by way of example and not limitation in the figures of the accompanying drawings, in which.

DETAILED DESCRIPTION

Systems and device disclosed herein are for magnetic hair piece attachment without the need for adhesives applied to a skin of a person. The systems and devices disclosed herein may use at least two of: a clip, a clasp, and a stay. The clip and clasp may have one or more magnets and be attached to a hair of the person. The stay may have one or more magnets and be attached to the hair piece or a wig cap. The disclosed system and method allows for the rapid application and removal of a hair piece from a person via the magnets in the clip, clasp, and/or stay.

Figure 1:
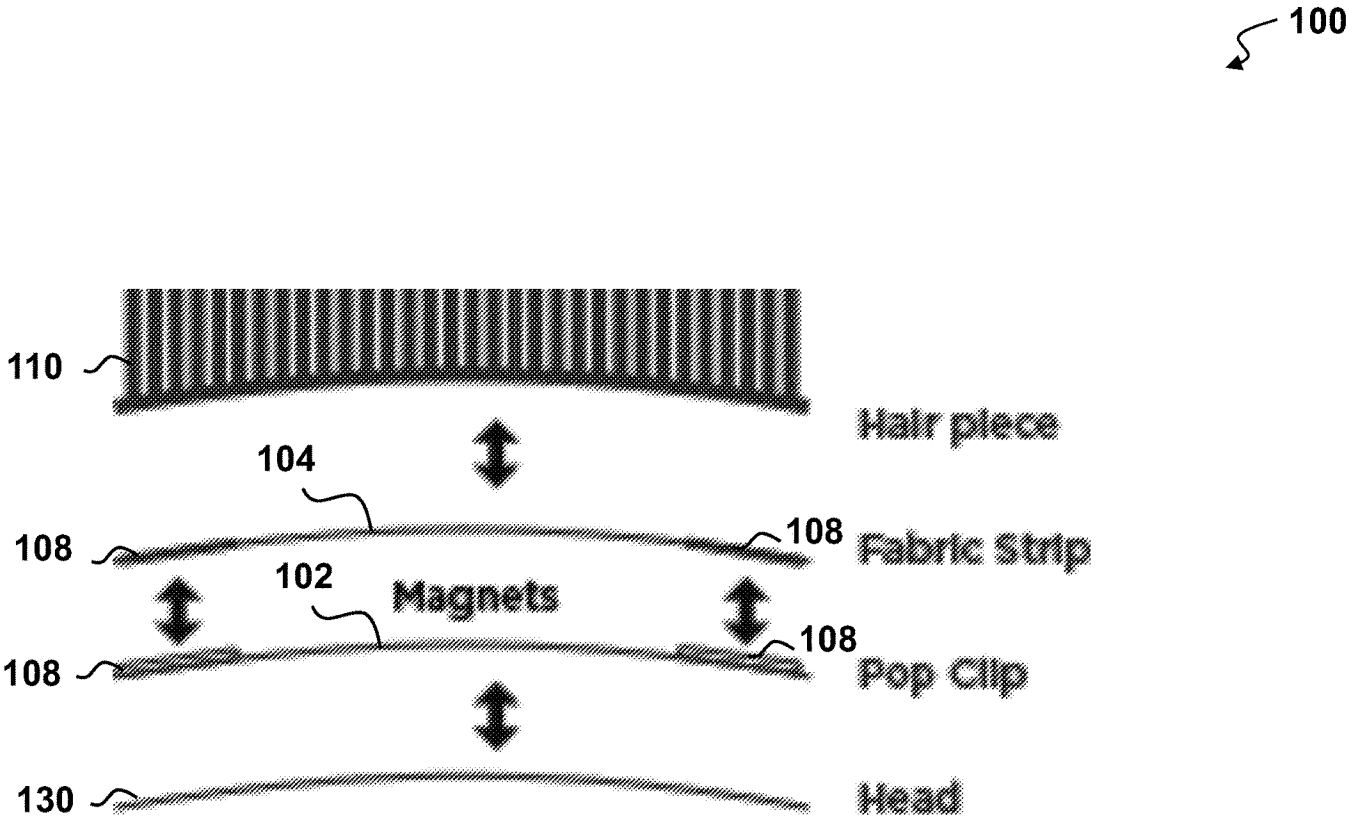
FIG. 1 depicts a system for providing for a magnetic hair piece attachment device.

With respect to FIG. 1, a system 100 providing for a magnetic hair piece attachment device 100 is illustrated. The magnetic hair piece attachment device 100 may include a clasp 102, a stay 104, and at least one magnet 108 associated with the clasp 102 and the stay 104. The magnetic hair piece attachment device 100 may provide for securing a hair piece 110 (or wig) to hair on a head 130 in place without the need for adhesives to be applied to the head 130, hair, or hair piece 110, and without the need for pins, such as hairpins, bobby pins, and the like. This mitigates discomfort for the wearer of the hair piece 110 that may be caused by adhesives or hairpins. The magnetic attachment of a hair piece 110 provided by the magnetic hair piece attachment device and system 100 disclosed herein further expedites the application, removal, and interchanging of hair pieces that the magnetic hair piece attachment device 100 may be incorporated into, since adhesives may take time to dissolve and/or detach from skin, hair, or a hair piece itself. Furthermore, the magnetic hair piece attachment device 100 may provide for securing the hair piece 110 (or wig) in place without the need for sewing of a hair piece attachment device directly into the hair piece 110.

Figure 2:
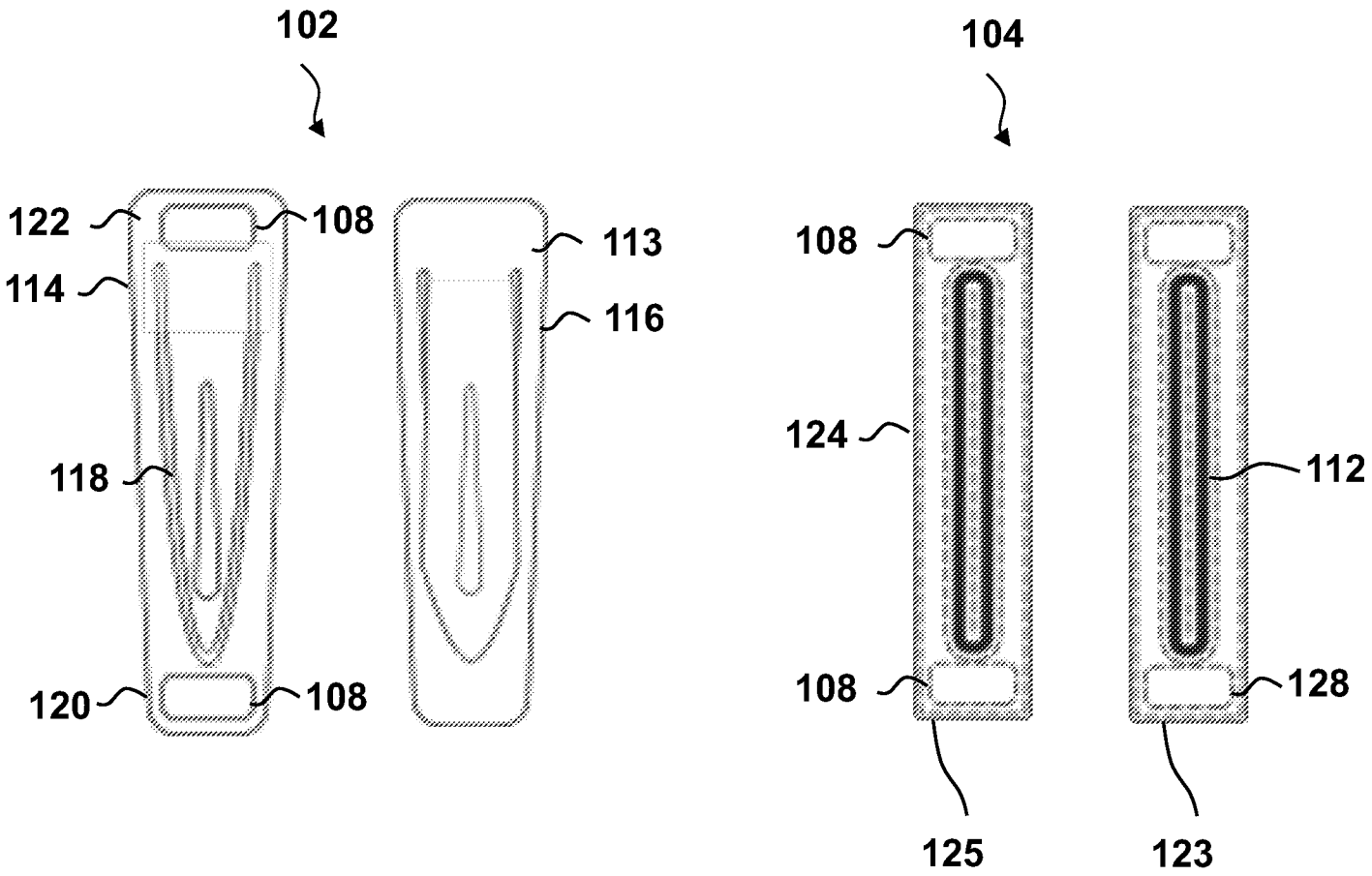
FIG. 2 depicts a clasp and a stay associated with the magnetic hair piece attachment device of FIG. 1.

With respect to FIG. 2, the clasp 102 may be formed from a single piece of thin metal, such as iron, nickel, steel, or aluminum. The clasp 102 may include a body 113 an outside portion 114 and an inside portion 116, and a middle portion 118 that may extend away from the body 102. In one embodiment, the clasp 102 may be flexible and of a curved shape to allow the clasp 102 to bow inwards and outwards. More specifically, upon applying a force to the clasp 102, the clasp 102 may bend inwards allowing the middle portion 118 to extend away from the body 113. With a distal end of the middle portion 118 extended away from the clasp 102, the clasp 102 may slide through hair, with hair going between the middle portion 118 and the body 113. Applying a force to the clasp 102 to bend the clasp 102 outwards causes the middle portion 118 to snap back into place and secure the clasp 102 to the hair.

In one embodiment, the clasp 102 is 10.6 mm wide at a bottom end 120 and 14 mm wide at a top end 122. Other dimensions of the clasp 102 are possible and contemplated. The clasp 102 may be slightly wider at either the bottom end 120 or the top end 122. The clasp 102 may also be slightly narrower at either the bottom end 120 or the top end 122. In one embodiment, the clasp 102 is 50 mm in length. The clasp 102 may be slightly longer or shorter than 50 mm in some embodiments.

In one embodiment, two magnets 108 may be attached to the outside portion 114 of the clasp 102. More specifically, a first magnet 108 may be attached at the top end 122 of the outside portion 114 of the clasp 102 and a second magnet 108 may be attached at the bottom end 120 of the outside portion 114 of the clasp 102. The top end 122 of the outside portion 114 of the clasp 102 may be distal from the bottom end 120 of the outside portion 114 of the clasp 102. In one embodiment, the magnets 108 are of rectangular shape, with a width of 8 mm and a height of 4 mm. Other possible shapes and dimensions for the magnets 108 are possible and contemplated, such as circular, oval, and square shapes. In another embodiment, the magnet 108 associated with the bottom end 120 may be of a smaller height and width than the magnet 108 of the top end 122, since the bottom end 120 may be narrower than the top end 122. The magnets 108 may be thin as to not alter the profile of the hair piece 110 with which the magnets 108 are attached (see FIG. 3). In one embodiment, the magnets 108 are 1 mm thick, though the thickness may range from 0.5 mm to 3.0 mm.

In one embodiment, the magnets 108 are soldered to the clasp 102. In another embodiment, the magnets 108 may be attached to the clasp 102 with an epoxy, such as glue. In one embodiment, the magnets 108 are Neodymium magnets. In another embodiment, the magnets 108 are permanent magnets, such as ceramic or ferrite magnets, and may be composed of sintered iron oxide and barium or strontium carbonate. In other embodiments, the magnets 108 are Neodymium iron boron (NdFeb), Samarium Cobalt (SmCo), or Alnico magnets. In yet another embodiment, the magnets 108 are temporary magnets with varied composition.

The stay 104 may have an outside portion 123 and an inside portion 125. In one embodiment, a central portion 124 of the stay 104 may composed of a durable elastomeric material, such as polyurethane. In one embodiment, the polyurethane stay 104 is a thermosetting polymer that may not melt when heated. The stay 104 may be flexible, tear-resistant, and may withstand repetitive stresses. The stay 104 may further include outer portions 126 composed of a different material as the central portion 124, such as lace. In one embodiment, the stay 104 may have a fabric casing (e.g., lace) surrounding the outside portion 123, the inside portion 125, and the central portion 124. Magnets, such as magnets 108, may be attached to the outer portions 126 of the clasp 102. More specifically, the magnets 108 may be sewn directly into the outer portions 126 with a stitching 128. In another embodiment, the stay 104 is entirely composed of a durable elastomeric material, such as polyurethane, and the magnets 108 are attached to the stay 104 with an adhesive, such as glue. In one embodiment, the stay 104 may have a metal ridge 112 running longitudinally between the magnets 108 and sewn into the stay 104 with the stitching 128. In other embodiments, the stay 104 may be constructed without a metal ridge 112.

In one embodiment, the magnets 108 of the stay 104 are identical in size to the magnets 108 of the clasp 102. In one embodiment, the dimensions of the stay 104 are identical, or nearly identical to the dimensions of the clasp 102. In another embodiment, the dimensions of the stay 104 may be up to 2 mm greater on all sides of the stay 104 than the clasp 102 to provide for a user to sew the stay 104 into the hair piece 110. In one embodiment, the stay 104 may be 11 mm wide and 50 mm tall. In another embodiment, the stay 104 may have a width between 5 mm and 15 mm and a height between 20 mm and 100 mm. Other dimensions for the stay 104 are possible and contemplated.

Figure 3:
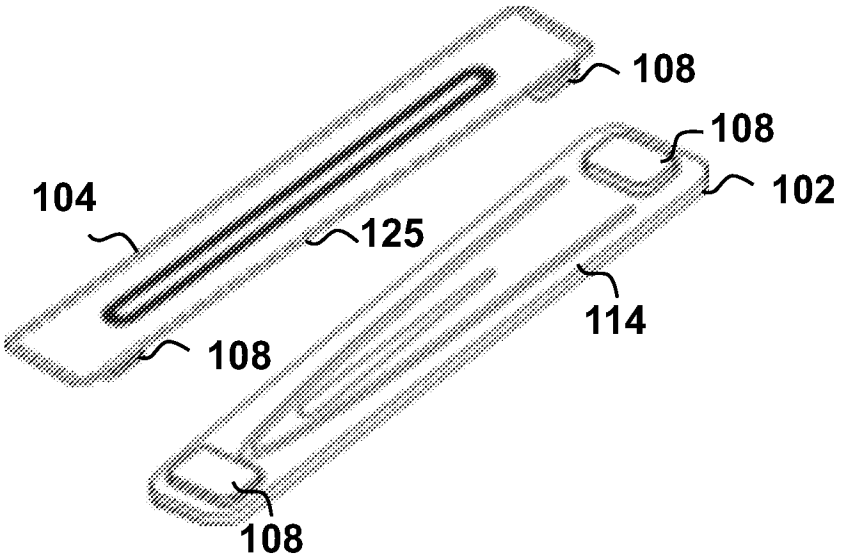
FIG. 3 depicts an alternative stay associated with magnetic hair piece attachment device of FIG. 1.

With respect to FIG. 3, in one embodiment, the stay 104 may be sewn into the hair piece (110, FIG. 1). The clasp 102, which is connected to hair on the head 130, and the stay 104 may be brought into contact and secured together with the magnets 108. More specifically, the magnets 108 attached to the inside portion 125 of the stay 104 are aligned with the magnets 108 of the outside portion 114 of the clasp 102. Upon alignment and connection of the clasp 102 and the stay 104 via the magnets 108, the magnetic hair piece attachment device 100 may flex and inward and outward to conform to the shape of the head (see FIG. 1).

Figure 4:
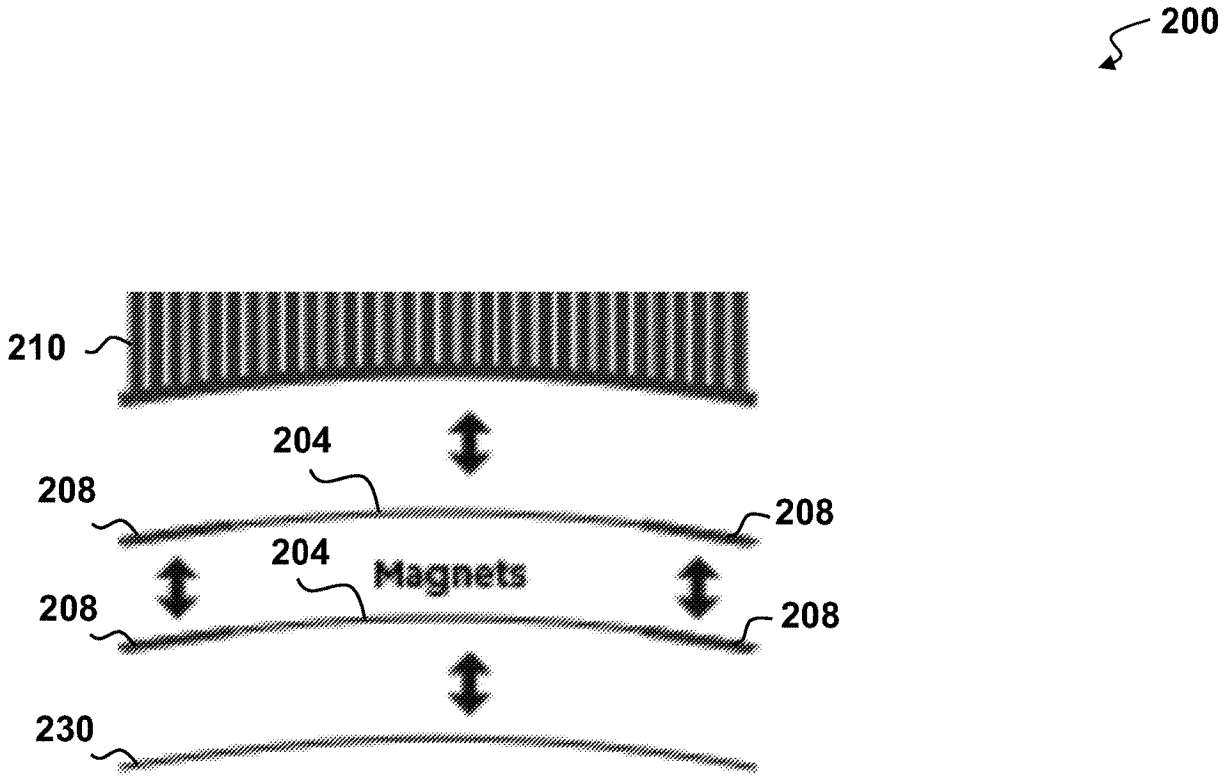
FIG. 4 depicts an alternative system for providing for a magnetic hair piece attachment device.

With respect to FIG. 4, an alternative system 200 providing for a magnetic hair piece attachment device is illustrated. The magnetic hair piece attachment device 200 may include two stays 204, and at least one magnet 208 associated with each stay 204. The magnetic hair piece attachment device 200 may provide for securing a hair piece 210 (or wig) to the skin on a head 230 or to a head piece, such as a wig cap worn on the head 230. In one embodiment, a first stay 204 may be sewn directly into a wig cap, and a second stay 204 may be sewn into the hair piece 210. Configured as such, the magnetic hair piece attachment device 200 does not require adhesives to be applied to the head 230 or hair piece 210, and without the need for pins, such as hairpins, bobby pins, and the like. This mitigates discomfort for the wearer of the hair piece 210 that may be caused by adhesives or hairpins. The magnetic attachment of a hair piece 210 provided by magnetic hair piece attachment device 200 further expedites the application, removal, and interchanging of hair pieces that the magnetic hair piece attachment device 200 may be incorporated into, since adhesives may take time to dissolve and/or detach from skin of the head 230, head rag, or hair piece 210 itself.

Figure 5:
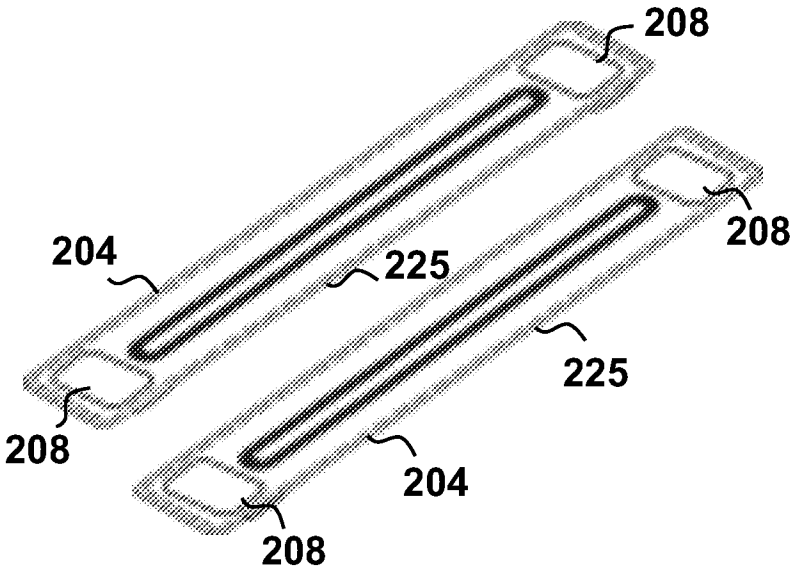
FIG. 5 depicts stays associated with the magnetic hair piece attachment device of FIG. 4.

With respect to FIG. 5, in one embodiment, the stays 204 and magnets 208 are identical to the stays 104 and magnets 108 of FIGS. 1-3. The two stays 204 may be brought into contact and secured together with respective magnets 208 of each of the two stays 204. More specifically, the magnets 208 attached to the inside portion 225 of a first stay 204 are aligned with the magnets 208 attached to the inside portion 225 of a second stay 204. Upon alignment and connection of the stays 204 via the magnets 208, the magnetic hair piece attachment device 200 may flex to conform to the shape of the head (see FIG. 4).

Figure 6:
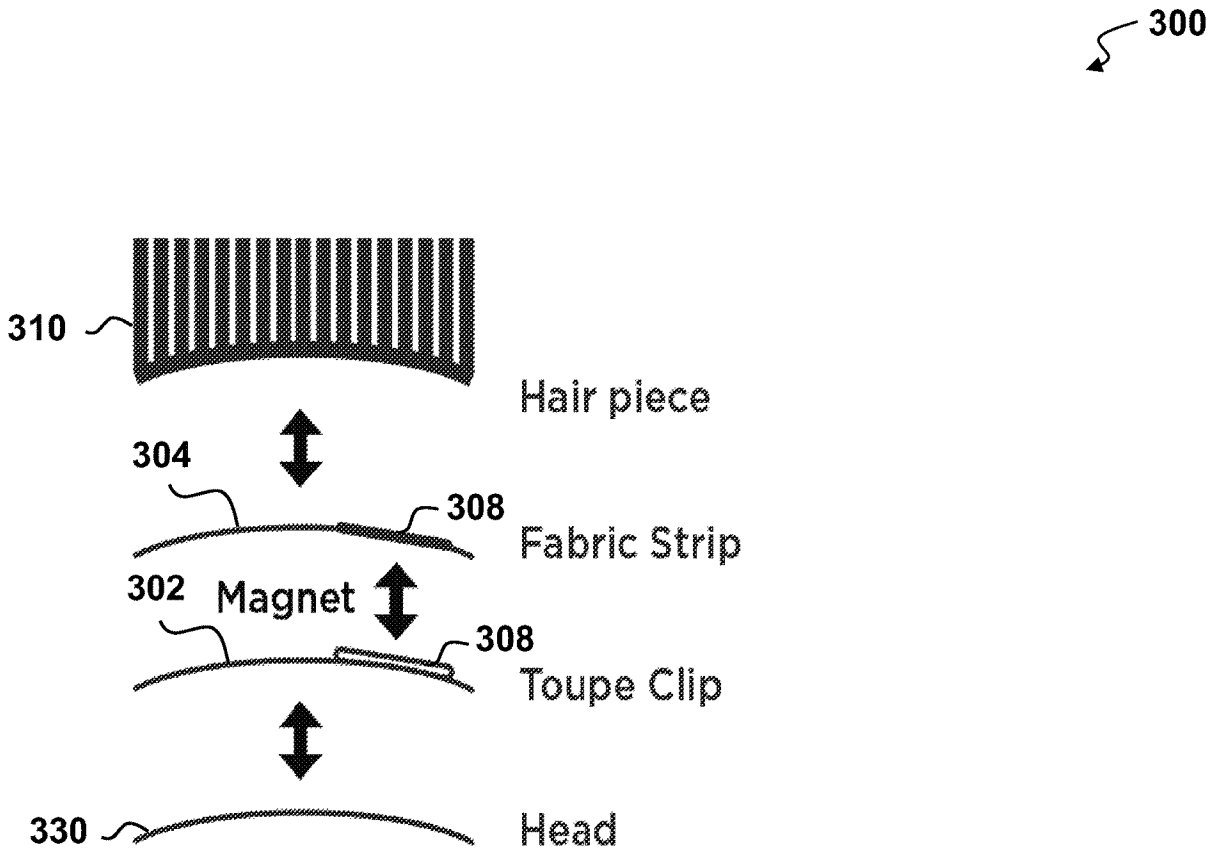
FIG. 6 depicts an alternative system for providing for a magnetic hair piece attachment device.

With respect to FIG. 6, an alternative system 300 providing for a magnetic hair piece attachment device is illustrated. The magnetic hair piece attachment device 300 may include a clip 302, a stay 304, and at least one magnet 308 associated with the clip 302 and the stay 304. The magnetic hair piece attachment device or system 300 may provide for securing a hair piece 310 (e.g., a partial hair piece, such as a toupee) to hair on a head 330, such as on the sides of the head 330. This is advantageous in cases where a user of the magnetic hair piece attachment device 300 may have little to no hair on the top of the user's head, but may have hair on the sides and back of the user's head. The magnetic hair piece attachment device 300 may not require adhesive to be applied to the head 330, hair, or hair piece 310, nor does the magnetic hair piece attachment device 300 require pins, such as hairpins, bobby pins, and the like. This mitigates discomfort for the wearer of the hair piece 310 that may be caused by adhesives or hairpins. The magnetic attachment of a hair piece 310 provided by magnetic hair piece attachment device 300 further expedites the application, removal, and interchanging of hair pieces that the magnetic hair piece attachment device 300 may be incorporated into, since adhesives may take time to dissolve and/or detach from skin, hair, or a hair piece itself. Furthermore, the magnetic hair piece attachment device 300 may provide for securing the hair piece 310 in place without the need for sewing of a hair piece attachment device directly into the hair piece 310.

Figure 7:
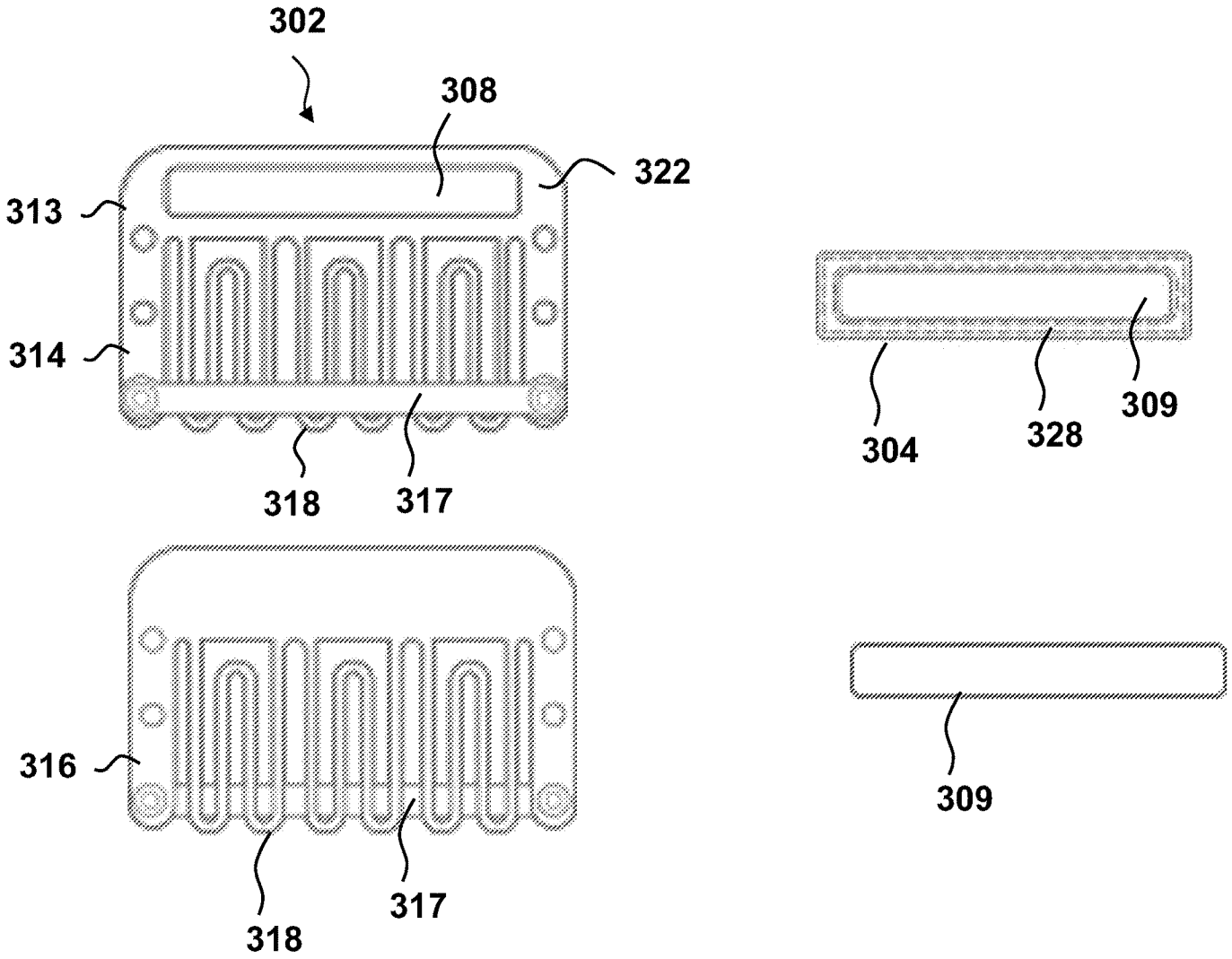
FIG. 7 depicts a clip and a stay associated with the magnetic hair piece attachment device of FIG. 6.

With respect to FIG. 7, the clip 302 may be formed from a single piece of thin metal, such as iron, nickel, steel, or aluminum. The clip 302 may include a body 313 with a plurality of teeth 318 extending therefrom, an outside portion 314 and an inside portion 316. In one embodiment, the teeth 318 may be separate protrusions. In other embodiments, the teeth 318 may be a series of connected protrusions so as to avoid scraping a head 330 of the wearer. The clip 302 may be flexible to allow the clip 302 to bend and adjust to the shape of a head. The teeth 318 may slide through hair. The hair may also slide between the teeth 318 and a bar running horizontally 317 along the length of the clip 302 allowing the clip 302 to be secured to the hair.

In one embodiment, the clip 302 is 42.3 mm wide. The clip 302 may be slight wider or narrower than 42.3 mm. In one embodiment, the clip 302 is 26.2 mm in height. The clip 302 may be slight longer or shorter than 26.2 mm. Other dimensions for the clip 302 are possible and contemplated.

In one embodiment, a first magnet 308 may be attached to a top portion 322 of the outside portion 314 of the clip 302. More specifically, the magnet 108 may run laterally across the top portion 314. In one embodiment, the magnet 108 is of rectangular shape, with a width of 31.7 mm and a height of 4.5 mm. Other possible shapes and dimensions for the magnet 308 are possible and contemplated, such as circular, oval, and square shapes. The magnet 308 may be thin as to not alter the profile of the hair piece 310 with which the magnet 308 is attached (see FIG. 6). In one embodiment, the magnet 308 may be 1 mm thick, though the thickness may range from 0.5 mm to 3.0 mm in some embodiments.

In one embodiment, the magnet 308 is soldered to the clip 302. In another embodiment, the magnet 308 may be attached to the clip 302 with an epoxy, such as glue. In one embodiment, the magnet 308 is permanent magnets, such as ceramic or ferrite magnets, and may be composed of sintered iron oxide and barium or strontium carbonate. In other embodiments, the magnet 308 is Neodymium iron boron (NdFeb), Samarium Cobalt (SmCo), or Alnico magnets. In another embodiment, the magnets 308 are temporary magnets with varied composition.

The stay 304 may be made of a durable fabric, such as lace. The stay 304 may be flexible, tear-resistant, and may withstand repetitive stresses. A magnet 309 may be sewn directly into the stay 304 with stitching 328. In one embodiment, the magnet 309 is identical to magnet 308 of the clip 302. The length and width of the stay 304 may be marginally larger than the magnet 309 for accommodating the magnet

309 to be sewn into the stay 304. In another embodiment, the stay 304 is entirely composed of a durable elastomeric material, such as polyurethane, and the magnet 308 may be attached to the stay 304 with an adhesive, such as glue.

In one embodiment, the width of the stay 104 may be identical, or nearly identical to the width of the clip 302. In one embodiment, the stay 304 is 42.3 mm wide and 8.0 mm tall. In another embodiment, the dimensions of the stay 304 may be up to 2 mm greater on all sides of the stay 304 than the clip 302 to provide for a user to sew the stay 104 into the hair piece 310. Other dimensions for the stay 104 are possible and contemplated.

Figure 8:
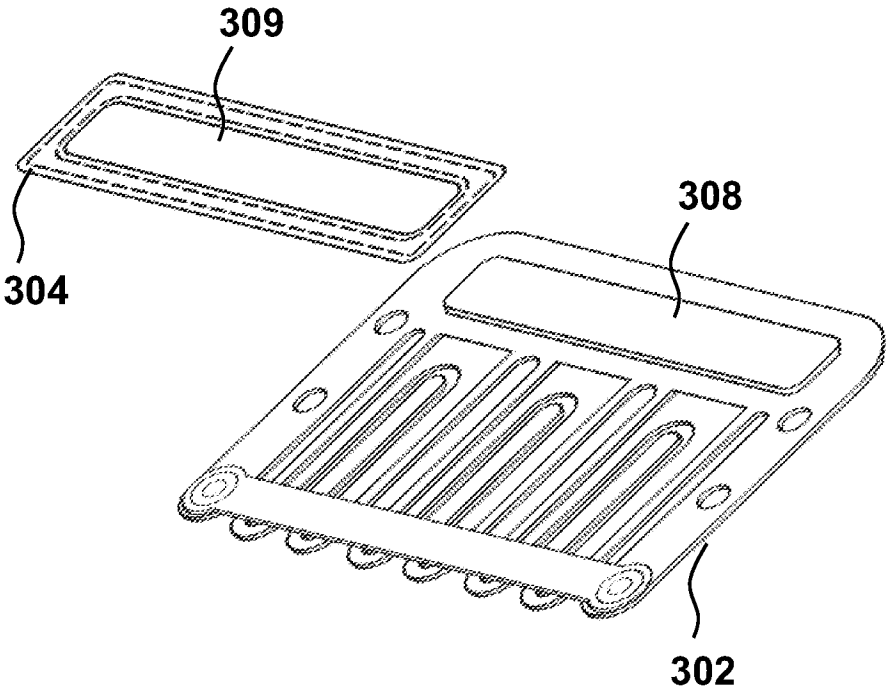
FIG. 8 depicts a magnetic attachment of the stay to the clip of FIG. 7.

With respect to FIG. 8, in one embodiment, the stay 304 may be sewn into the hair piece 310. The clip 302, which is connected to hair on the head 330, and the stay 304 may be brought into contact and secured together with the magnets 308, 309. More specifically, the magnet 308 attached to outside portion 314 of the clip 302 is aligned with the magnet 309 of the stay 304. Upon alignment and connection of the clip 302 and the stay 304 via the magnets 308, 309 the magnetic hair piece attachment device 300 may flex conform to the shape of the head (see FIG. 6).

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further, it is intended that the scope of the present invention is herein disclosed by way of examples and should not be limited by the particular disclosed embodiments described above.

What is claimed is:

1. A system comprising:

a first stay comprising one or more magnets;

a second stay comprising one or more magnets;

wherein the first stay is detachably attached to the second stay via the one or more magnets of the first stay and the one or more magnets of the second stay; and wherein the first stay is configured to attach to a hair piece;

wherein the second stay is configured to attach to a wig cap to be worn on a head;

wherein the one or more magnets of the first stay comprise two magnets, wherein a first magnet of the two magnets of the first stay is disposed at a top end of the first stay, wherein a second magnet of the two magnets of the first stay is disposed at a bottom end of the first stay, wherein the one or more magnets of the second stay comprise two magnets, wherein a first magnet of the two magnets of the second stay is disposed at a top end of the stay, and wherein a second magnet of the two magnets of the second stay is disposed at a bottom end of the second stay; and wherein the first stay further comprises a metal ridge running longitudinally between the first magnet of the first stay and the second magnet of the first stay, and wherein the second stay further comprises a metal ridge running longitudinally between the first magnet of the second stay and the second magnet of the second stay.

* * * * *